US005397149A

United States Patent [19]

Couderc et al.

[11] Patent Number: 5,397,149

[45] Date of Patent: Mar. 14, 1995

[54] DEVICE FOR MODIFYING THE NATURAL PRESSURE DISTRIBUTION OF A SKI OVER ITS SLIDING SURFACE, AND A SKI EQUIPPED THEREWITH

[75] Inventors: Bernard Couderc, Annecy; Pierre Szafranski, Pringy, both of France

[73] Assignee: Salomon S.A., Annecy Cedex, France

[21] Appl. No.: 12,436

[22] Filed: Feb. 2, 1993

[30] Foreign Application Priority Data

Feb. 18, 1992 [FR] France ..... 92 01958

[51] Int. Cl.[6] ..... A63C 5/07; A63C 7/10

[52] U.S. Cl. ..... 280/602; 280/605; 280/607

[58] Field of Search ..... 280/605, 618, 607, 617, 280/602, 604, 601, 633

[56] References Cited

U.S. PATENT DOCUMENTS

| | | | |
|---|---|---|---|
| 2,560,693 | 7/1951 | Hickman | 280/610 |
| 3,992,030 | 11/1976 | Salomon | 280/605 |
| 4,061,356 | 12/1977 | Salomon | 280/605 |
| 5,033,766 | 7/1991 | Sedlmair et al. | 280/605 |
| 5,135,250 | 8/1992 | Abondance et al. | 280/617 |

FOREIGN PATENT DOCUMENTS

| | | |
|---|---|---|
| 0183586 | 6/1986 | European Pat. Off. . |
| 0409749 | 1/1991 | European Pat. Off. . |
| 2259375 | 6/1974 | Germany . |

*Primary Examiner*—Mitchell J. Hill
*Assistant Examiner*—Michael Mar
*Attorney, Agent, or Firm*—Sandler Greenblum & Bernstein

[57] ABSTRACT

A device adapted to modify the pressure distribution of a ski, such as especially an alpine ski, over its sliding surface. The device includes a sensor element adapted to sense the vertical biases of the boot, and also a linking device in order to transmit, at least towards one of the ends of the ski, in the form of a flexional moment, at least a portion of the vertical, downward thrust of the boot sensed by the sensor element. The linking device includes a calibration device to induce a pre-stress. The linking device also has a sensor which is sensitive to the presence or absence of the boot so as to automatically control the calibration device in accordance with the presence or absence of the boot. A ski brake is also provided. The brake arms are borne by one of the levers constituting the linking device and the calibration device.

41 Claims, 12 Drawing Sheets

4
10
17
18
20
25
29
35
38
40
43
44
45
46
47
49
50
51
60
76

DEVICE FOR MODIFYING THE NATURAL PRESSURE DISTRIBUTION OF A SKI OVER ITS SLIDING SURFACE, AND A SKI EQUIPPED THEREWITH

BACKGROUND OF THE INVENTION

1. Field of the Invention

The invention is related to a device whose object is to modify the natural pressure distribution of a ski, such as especially an alpine ski, over its sliding surface.

The invention is also related to a ski brake that is adapted to brake the movement of a ski, especially an alpine ski, in case the boot which is retained on the ski is released. The invention is also related to a ski equipped with the device or the brake mentioned hereinabove.

2. Description of Background and Relevant Information

Skis that are used for alpine skiing are constituted by relatively long members, the boots of the skier being retained thereupon by front and rear binding elements. The boots and the binding elements are located approximately in the median zone of the ski, which is commonly known as the middle sole. The skis themselves possess a natural arch at rest, whereby the middle sole is naturally raised with respect to the front end of the ski or spatula, and the rear end of the ski or heel. In addition, the skis possess a flexibility, which is a function of their internal structure. During use, the ski deforms elastically in response to the various stresses to which it is subject from the skier and from the terrain on which it slides.

The main bias to which the ski is subject is constituted by the weight of the skier, and by the reaction to which the sliding surface subjects the ski.

The ski is also biased by the binding elements. It is, in fact, known that the binding elements pinch the boot along a longitudinal direction. The reaction to this pinching action is transmitted by the binding elements to the ski. This reaction, however, differs in nature according to the assembly mode of the rear binding element to the ski. Indeed, some rear binding elements are directly assembled to the ski, whereas others are assembled on the front binding element by a non-extensible link, such as a metallic plate which extends beneath the boot.

The ski is also influenced by the position of the skier on his boots, depending on whether he carries his weight towards the front or towards the rear.

It is known that the behavior of the ski on snow can be modified, especially the ease with which it handles turns, and the quality of its movements at turns, or in a straight line, by influencing the arch of the ski, or else by playing with the longitudinal pressure distribution of the ski on the snow. By playing with this pressure distribution, it is known that the ski can be rendered more or less pivotal or more or less guiding, i.e., one can promote its ability to turn easily or to display great stability of movement. In currently available skis, the pressure distribution of the ski on the snow is determined mainly by the internal structure of the ski, and by the assembly mode of the binding elements to the ski, that is, with or without the connection plate between the front and rear elements. Pressure distribution can also be influenced by the intensity of the thrust that is provided to the return springs.

There exist devices with attached elements that enable the pressure distribution of the ski on the snow to be modified. As such, European Patent Application No. 183,586 describes a plate of an elastic material of a spring blade type attached above the ski, between the binding elements and the ski. This blade has cursors at the level of its front and rear ends, by virtue of which a part of the forces to which the ski is subject are transmitted vertically. This device, however, has a disadvantage of providing only mediocre performance and it is very cumbersome. It is adapted for cases where both feet of the skier are in support on the same ski, so as to avoid the entire weight of the skier from being concentrated in the middle sole zone. On the other hand, it is ill-adapted to cases where a pair of traditional skis are used.

Also known, as exemplified by European Patent Publication No. 409,749, is a device constituted by a plate which is raised with respect to the upper surface of the ski and is maintained between two longitudinal abutments. The elastic shock absorption means are positioned between the plate and the abutments, and the pre-stress exerted on such elastic means is adjustable. As for the bindings, they are assembled on the plate. This device provides good results, but its disadvantage is that the binding elements are affixed to the attached plate and not to the ski itself.

Other devices of the same type are described for example in U.S. Pat. No. 2,560,693 and the German Patent No. 2,259,375. With respect to these devices, it must be noted that the influence that they exert on the flexion of the ski is of the static type, i.e., of the type that does not take into account the position of the skier on his skis while sliding.

It must be noted, in addition, that in these devices, the pre-stress that the attached element induces on the ski itself cannot be eliminated. This pre-stress affects the ski, even in the absence of the boot, and even when the skis are stored. The ski is therefore continually subject to a stress that affects its flexion, even at rest. It can thus be subject to an irreversible deformation due to this pre-stress.

In addition, these devices are provided to be equipped with standard binding and braking elements. In particular, there is no provision for specific brake arrangements that take into account the presence of the element that has been attached onto the ski.

SUMMARY OF THE INVENTION

One of the objects of the invention is to provide a device that enables dynamic modification of the pressure distribution of a ski over its sliding surface, i.e., a device that takes into account the position of the skier on his or her skis, and the vertical thrust force exerted by the skier on the skis.

Another object of the invention is to provide a device that provides, in addition, a suspension effect to the skier while sliding.

Yet another object of the invention is to provide a device that induces a pre-stress in the ski, this pre-stress being capable of being eliminated, especially in the absence of the boot, when the ski is stored.

Another object of the invention is to provide a ski brake whose elements are integrated into the pressure distribution device.

Other objects and advantages will become clearer upon reading the description that follows.

The device according to the invention is adapted to equip a ski, such as especially an alpine ski, with at least one binding element adapted to retain a boot in its central middle sole zone, and at least one support element on which the sole of the boot rests.

More particularly, the device provides:

a sensor element capable of sensing vertical biases of the boot, as well as linking means between the sensor element and the base, in order to transmit at least towards one of the ends of the base, in the form of a flexional moment, at least a part of the downward vertical thrust of the boot which is sensed by the sensor element, that the linking means include calibration means so as to induce, in the linking means, a pre-stress that can vary between two values, a determined non-zero value for sliding, and a zero value for other non-sliding circumstances, that the linking means have activation means sensitive to the presence or absence of the boot in order to automatically control the pre-stressing of the calibration means when the boot is engaged in the binding elements.

The ski brake according to the invention comprises at least one mobile brake arm between a working position wherein the arm projects beneath the lower surface of the ski, and a resting position wherein the arm rises along the lateral edges of the ski. It comprises activation means to bring back the arms from their working position to their resting position during engagement of the boot in the retention binding, and an energy means to elastically return the arms into the working position during release of the boot.

More particularly, the activation means comprise an assembly of two levers oriented along the longitudinal direction of the ski above such ski, the levers being journalled with respect to each other about a horizontal and transverse axis in the manner of a non-stable knuckle joint, mobile between an open position and a flattened position against the upper surface of the ski, wherein one of the levers bears the brake arms and wherein both levers are, in addition, connected to the base of the ski by linking means in which they generate a calibration pre-stress when the boot is engaged in the binding elements and activates the knuckle joint into a flattened position.

BRIEF DESCRIPTION OF THE DRAWINGS

The invention will be better understood with reference to the description that follows, as well as the annexed drawings which form an integral part of it, of preferred embodiments.

DETAILED DESCRIPTION OF THE PREFERRED EMBODIMENTS

Figure 1:
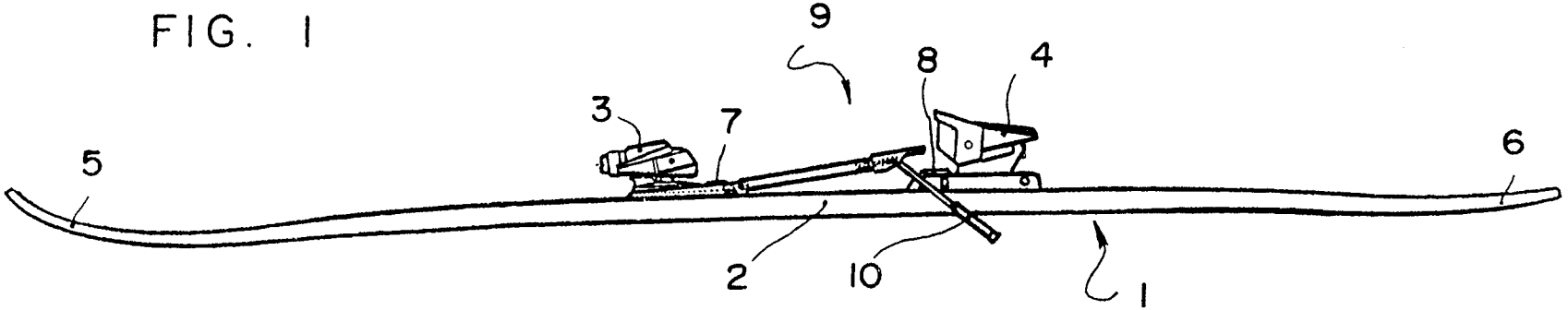
FIG. 1 is a general side view of a ski equipped with the device according to a first non-limiting embodiment of the invention.
Figure 2:
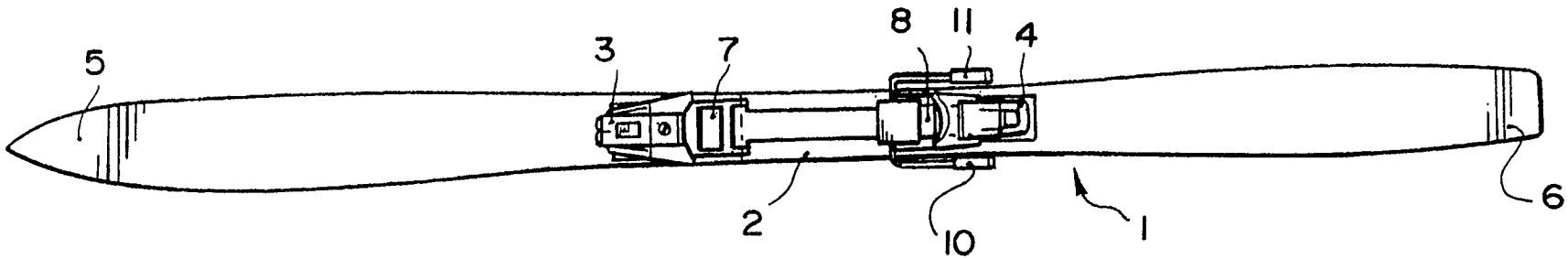
FIG. 2 is a top view of the device represented in FIG. 1.

FIG. 1 represents an alpine ski comprising a base 1, which is equipped in its middle sole zone 2 with a front binding element 3 and a rear binding element 4. Base 1 has an elongate shape, with a raised front end or spatula 5 and a rear end or heel 6.

The front and rear binding elements are of any appropriate type, and are not described in detail. They are adapted to retain the front and rear ends of the boot, and to release the boot when it exerts excessive bias on any of the elements.

In a known manner, in the case of the ski represented in FIG. 1, the sole of the boot rests on base 1 by a front support element 7, and a rear support element 8, which are respectively associated with the front binding element 3 and the rear binding element 4.

The device represented in FIG. 1 also comprises a brake 9 between the binding elements 3 and 4, such brake having two lateral braking arms 10 and 11, or more generally, at least one braking arm.

Figure 3:
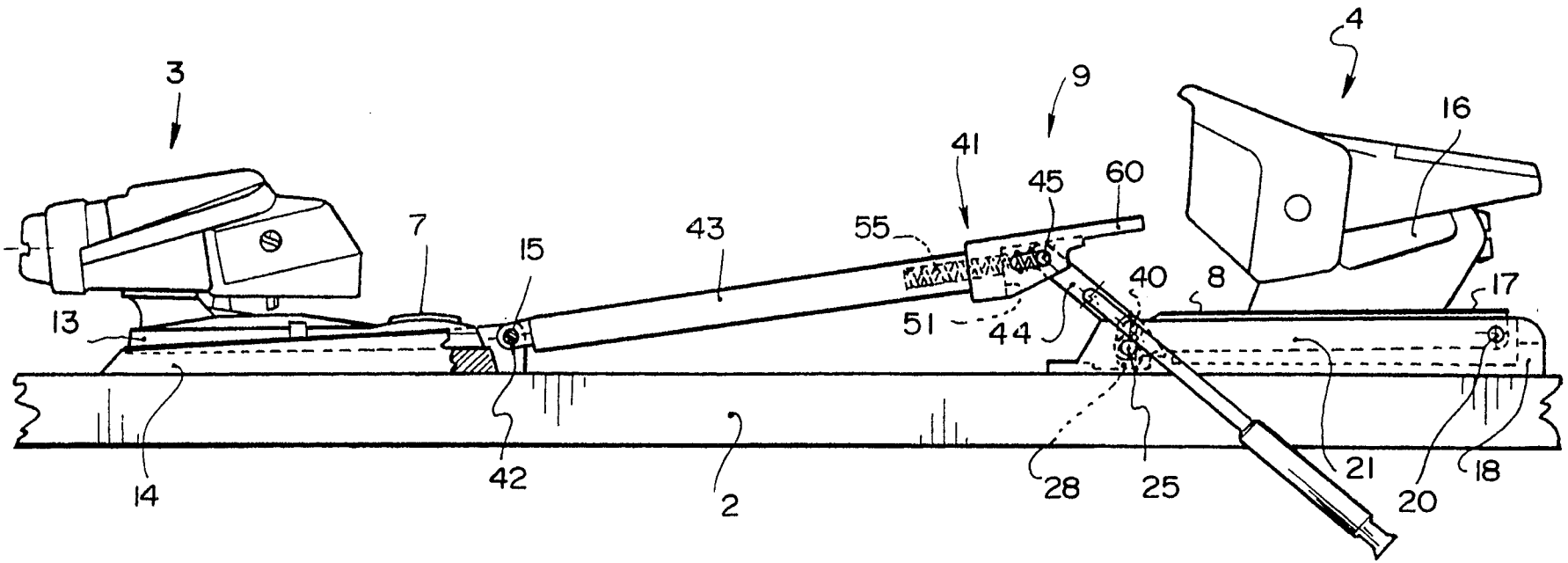
FIG. 3 is a partial sectional side view of the device represented in FIG. 1 in its middle sole zone.

With reference to FIG. 3, the front binding element 3 has in its lower portion a plate 13, which is affixed to the ski. Preferably, plate 13 is mounted on a base plate 14, which raises it slightly with respect to the upper surface of the base of the ski. The assembly constituted by plate 13 and base plate 14 is fixed by any appropriate means, for example, by screws which are not visible in FIG. 3. The rear portion of the base plate has an opening 15, so as to receive a horizontal and transverse axis. This housing is raised with respect to the upper surface of base 1. Its particular function is described further below.

The rear binding element 4 has, in a known manner, a body 16 which is longitudinally mobile along a slide 17. Slide 17 is connected to base 1 by means of a base plate 18 affixed to the ski.

Base plate 18 basically has two longitudinal and vertical wings 21 and 22, whose spacing is slightly greater than the width of slide 17, such that slide 17 can be engaged between the two wings. In FIG. 3 only wing 21 is visible.

The journal between slide 17 and base plate 18 takes place by a pivoting movement about an axis which is parallel to a transverse and horizontal direction. In FIG. 3, this axis is embodied as a journal axle or pin 20, which crosses slide 17 and base plate 18. Journal axle 20 is raised with respect to the upper surface of base 1. Naturally, this is not limiting, and any other journal means may suffice.

Slide 17 can thus pivot in a vertical and longitudinal plane defined by the longitudinal direction of the ski.

Conversely, it can be noted that the link between slide 17 and base plate 18 does not allow other movements of slide 17 except this movement in the median vertical and longitudinal plane of the ski.

Preferably, this pivoting movement is limited at least upwardly. These limiting means are represented in the drawings in the form of a transverse and horizontal pin 25, which is affixed to the front portion of slide 17, and whose ends cross wings 21 and 22 of base plate 18 at the level of the oblong openings 28 and 29. These openings are generally configured with respect to pin 25, so as to enable not only the vertical movement, but also the longitudinal movement of such pin. The upper portion of the oblong holes 28 and 29 constitutes an abutment for pin 25, said abutment limiting the upward movement of slide 17. The downward movement of the slide can be limited by the ski itself, or else by the lower portion of oblong holes 28 and 29.

Slide 17 is obtained from any appropriate material which can resist a compression bias directed along its length.

The device according to the invention also comprises a sensor element capable of sensing the vertical biases exerted by one end of the sole of the boot. Further, it comprises linking means between the sensor element and base 1 of the ski, in order to transform a vertical downward bias exerted on the sensor into at least one flexional moment which tends to make one end of the ski plunge towards the snow.

In the embodiment illustrated, the linking means basically comprise a pivoting or tipping element 35 and its support wedge 38, front linking means that are basically constituted of a linking element 41 connected to the front base plate 14, and rear linking means that are basically constituted of slide 17 which is connected to base plate 18.

The linking means transform the vertical downward thrust of the boot into two longitudinal thrust forces, respectively oriented frontwardly and rearwardly with respect to the ski. The longitudinal frontward thrusting force is exerted on front base plate 14 at the level of housing 15 which is described above. It is to be understood that a longitudinal force towards the front exerted at this level is transmitted to the base in the form of a flexional moment, which tends to make the spatula bend towards the snow. The longitudinal thrust towards the rear is exerted on rear base plate 18 at the level of journal axle 20 with slide 17. A longitudinal thrust force towards the rear exerted at this level is transmitted to the base in the form of a flexional moment which tends to make the heel of the base bend towards the snow.

The intensity of the flexional moments induced on the front and rear of the base depends on the intensity of the longitudinal thrusts, and also on the height of housings 15 or axle 20 with respect to the upper surface of the base.

Preferably, the front or rear linking means themselves comprise calibration means to induce in the linking means, between front base plate 14 and rear base plate 18, a thrust pre-stress which is also transmitted to tipping element 35. These calibration means are adjusted automatically in accordance with the presence or absence of the boot, between a zero or substantially zero value if the boot is absent and a determined value if the boot is present.

In the embodiment which is illustrated in the drawings, the linking means comprise, initially, a tipping element 35 having two arms, a vertical arm 35*a* and a horizontal arm 35*b*, oriented towards the rear. Tipping element 35 is borne by the front portion of slide 17, about pin 25 described previously. The pin crosses tipping element 35 in its central portion, at the level of the link between arms 35*a* and 35*b*.

Slide 17 which constitutes the rear linking means thus connects tipping element 35 to rear base plate 18.

The horizontal arm 35*b* of the tipping element extends behind pin 25 and it is in support, along a vertical direction, against wedge 38 affixed to the base. In the example illustrated, wedge 38 is a part of base plate 18. It could, however, be separate from the base plate and affixed to base 1.

In the upper portion of tipping element 35, approximately above the housing for pin 25, there is an opening for a horizontal and transverse axis 40, on which the front linking element 41 is connected. This element 41 is connected in its front portion to base plate 14 by a transverse axle 42 which is engaged in opening 15 of such base plate.

The front linking element 41 is constructed of two elements oriented along the longitudinal direction of base 1, said elements being journalled in the manner of a knuckle joint. Thus, linking element 41 comprises a front lever 43 and a rear lever 44 which are mutually journalled about a transverse and horizontal axis 45. The free front end of lever 43 is journalled at base plate 14 about the axis of axle 42 and the rear end of lever 44 is connected to tipping element 35 by the journal axis of axle 40. The knuckle joint thus formed by elements 43 and 44 is movable between an open position which is represented in FIG. 3 and a closed position which is represented in FIG. 4.

It is the boot represented by reference numeral 47 that enables the knuckle joint to pass from its open position to its closed or flattened position. In addition, the flattened position is an unstable position in terms of equilibrium, i.e., the central axis 45 is elastically and permanently returned upwardly, in such a way that as soon as the boot is released, the knuckle joint opens automatically.

According to the embodiment represented in FIGS. 3–7, journal axis 45 which is common to both levers 43 and 44 is borne by lever 44, and it is movable in a slot 50 of the other lever 43 which comprises two symmetrical portions carried by lateral wings 48 and 49, and is oriented along the longitudinal direction defined by such lever 43. When the knuckle joint passes from its open position to its flattened position, axis 45 moves along with the front portion of lever 44 and it crosses slot 50 of lever 43 towards the front.

Figure 4:
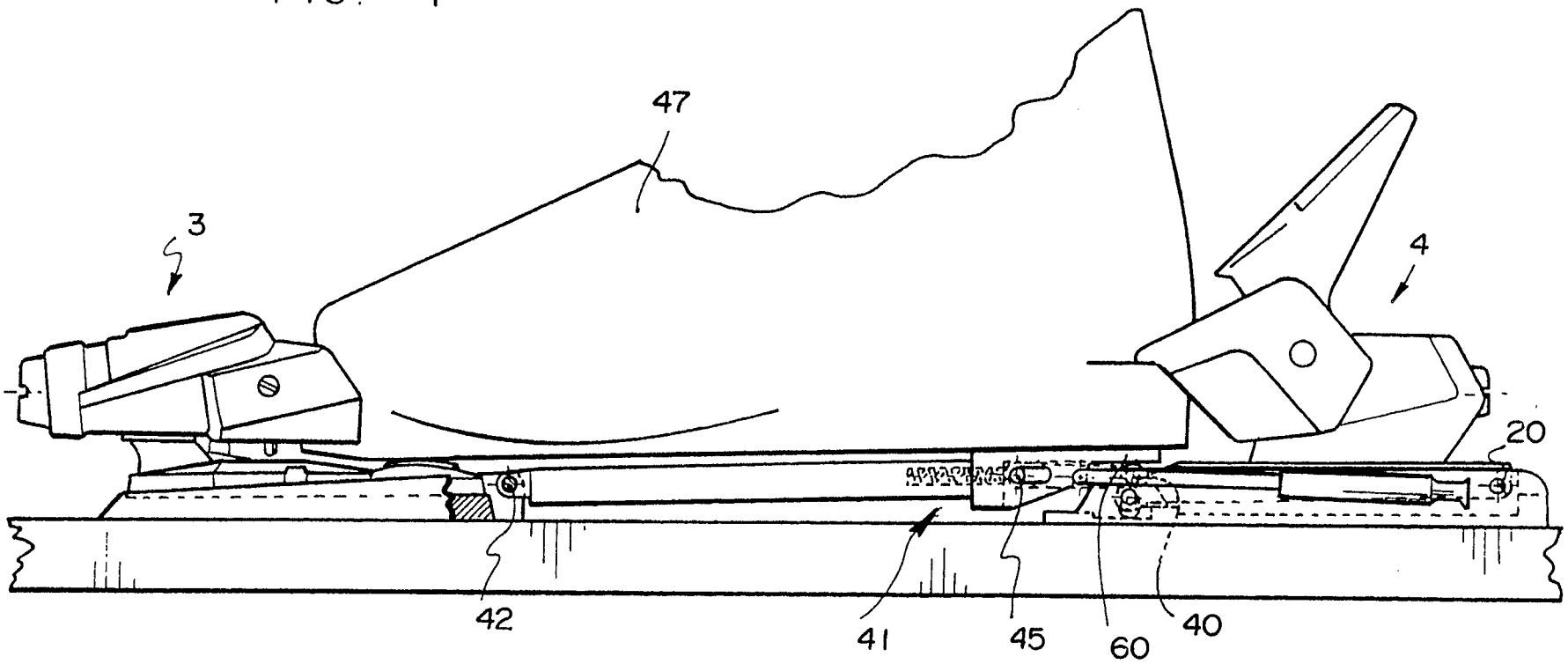
FIG. 4 is a view similar to FIG. 3 and illustrates another functional position of the device.

Preferably, in the flattened position of the knuckle joint, i.e., the position of FIG. 4, axle 45 is in abutment at the front of slot 50. In addition, in this position, rear lever 44 and front lever 43 are preferably in direct support against one another along a longitudinal direction, so as to transmit to one of these elements the compression stresses originating from the other. In the case of the drawings, lever 43 has, in its rear portion, just in front of slot 50, a vertical support face 51 against which the front end 52 of lever 44 becomes positioned when the knuckle joint is flattened.

An elastic return means is, moreover, provided to elastically return the knuckle joint into the open position. In the case of FIGS. 3–7, this elastic return means is constituted by an assembly of two springs 55 and 56, which are located in longitudinal housings 57 of front lever 43, these housings opening in their rear portion, at the level of support face 51, in such a way that the springs push the front end of lever 44 towards the rear.

In addition, journal axis of axle 45 of both levers 43 and 44 is permanently located above the alignment of the axes of axles 42 and 40, such that the knuckle joint is never totally closed. A wedge affixed to lever 43 or base 1 could also retain axis 45 above the alignment of axles 40 and 42.

However, this is non-limiting, and other appropriate elastic return means can be used.

The pre-stress which is induced by these calibration means in the linking means originates partially from the support of front end 52 of lever 44 against face 51 of front lever 43, from the stress that the closure of the knuckle joint induces, and partially from springs 55 and 56.

According to a preferred embodiment, front lever 43 extends in its rear portion beyond slot 50, by a plate or pallet 60. In the flattened position of the knuckle joint, pallet 60 is in contact with the sole of the boot, and it covers lever 44 up until journal axle 40 with tipping element 35. It must be noted that when the boot is present in the binding, the rear portion of the sole is in contact with pallet 60. The vertical downward bias to which the boot subjects pallet 60 is transmitted to tipping element 35 at the level of axle 40. Axle 40 is offset longitudinally with respect to the support of horizontal arm **35*b* of the tipping element on wedge 38, in such a way that a substantial downward bias tends to produce a rotation of the tipping element about its support on wedge 38. Pallet 60** constitutes a sensor element which is in contact with the sole of the boot at the level of its rear end, and which is capable of sensing the vertical biases of the boot, especially those oriented downwardly.

The functioning of the device that has been described is as follows.

In the absence of a boot, i.e., in the position of FIG. 3, springs 55 and 56 elastically return the knuckle joint constituted by levers 43 and 44 into its open position.

When the boot is engaged in the binding, as represented in FIG. 4, the rear portion of the sole of the boot takes support on pallet 60, which brings the knuckle joint into its flattened position, without, however, connection axis 45 between the two levers exceeding the alignment of axles 40 and 42, such that the knuckle joint is in a non-stable equilibrium, and so that it is maintained in this position only due to the presence of the boot. In this position, the pre-stress induced by the linking means, as well as by springs 55 and 56 is sufficient to maintain the tipping element in its raised position, i.e., a position wherein the ends of axle 25 are in abutment in the upper portion of oblong holes 28 and 29, when the boot is in normal equilibrium on the ski.

Figures 7, 11:
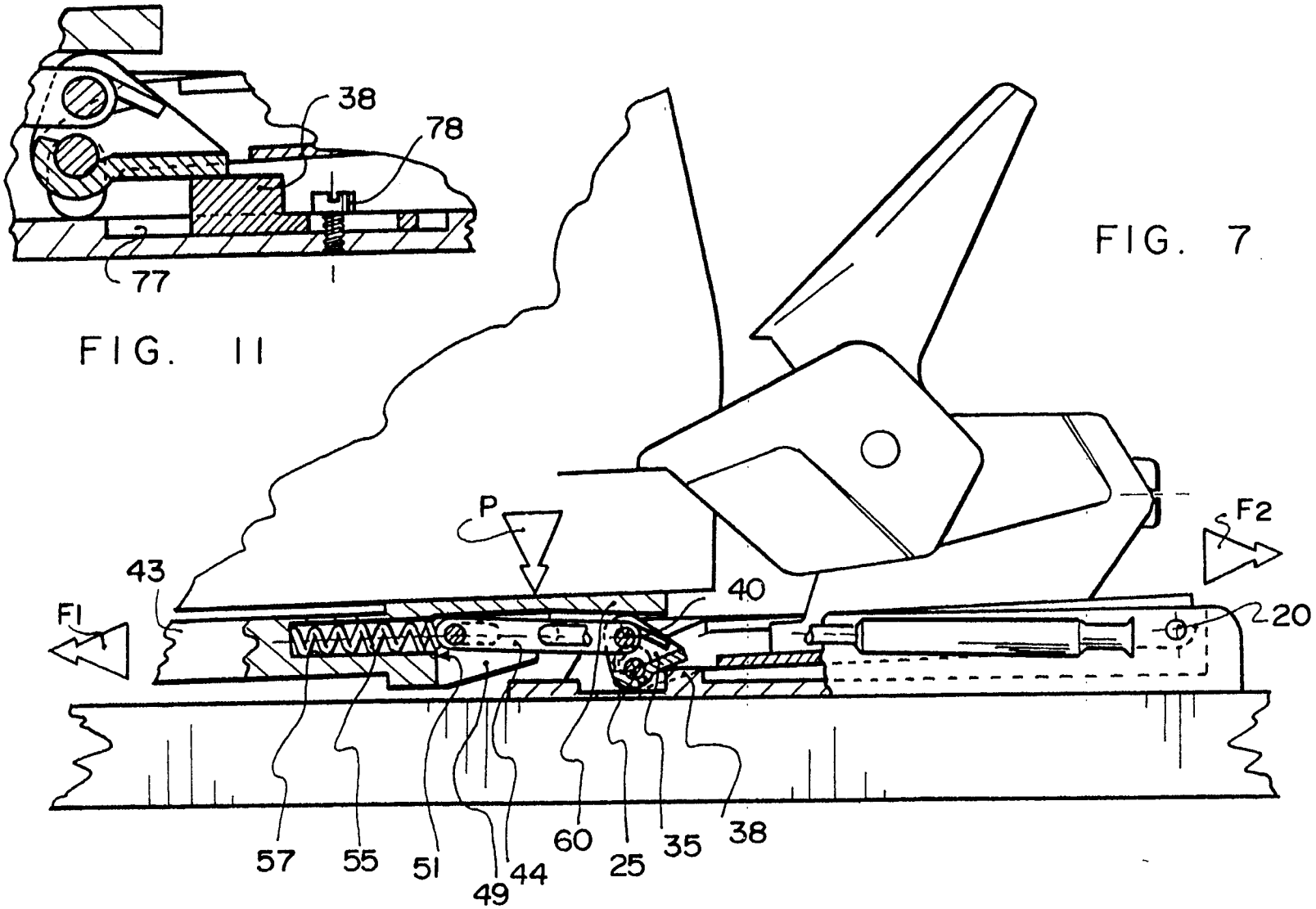
FIG. 7 is a side view similar to FIG. 5, and illustrates another functional position of the device.
Figure 8:
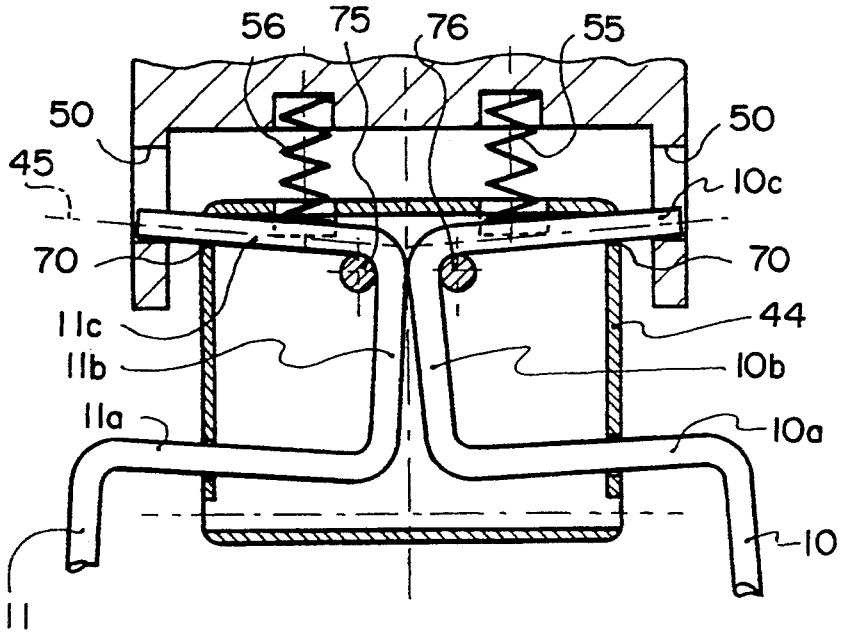
FIGS. 8 and 9 illustrate, in a schematic manner, the functioning mode of the brake according to a preferred embodiment of the invention.
Figure 9:
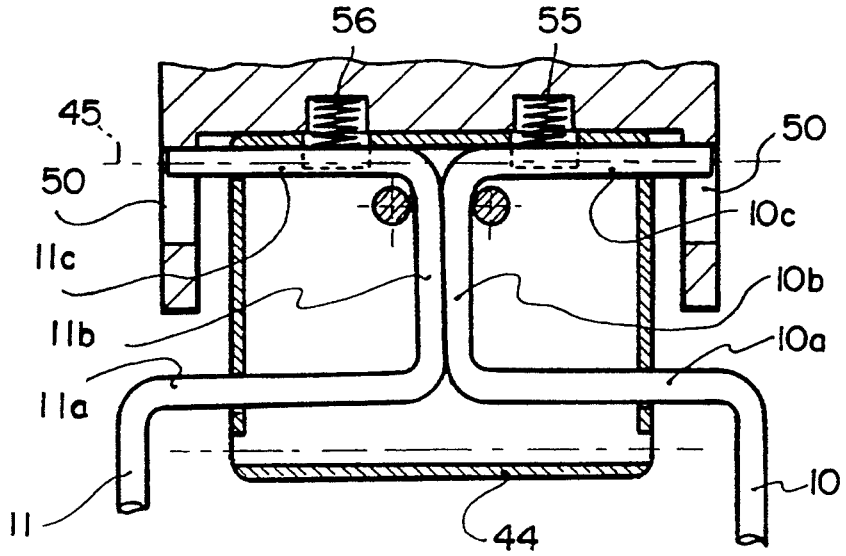

FIG. 7 illustrates the case wherein the rear end of the boot exerts, on the ski, an additional thrust P oriented vertically downwardly, which overcomes the pre-stress. This can occur especially when the skier bears his weight at the rear of the ski. In this case, this thrust P is transmitted to tipping element 35, and results in its pivoting about the support that the horizontal branch **35*b* of the tipping element takes on wedge 38. This pivoting tends to displace journal axis 40 of front linking element 41 towards the front, and journal axis 25 of slide 17 towards the rear. This induces, in the front linking element 41 and rear linking element 17, a thrust force which is oriented towards each of the ends of base 1, as has been illustrated in FIG. 7** by arrows F1 and F2.

The frontward thrust force F1 is transmitted to the front base plate 14 at the level of axle 42, and it induces on the front portion of the base of the ski a flexional moment which tends to make the spatula bend towards the snow. Similarly, the rearward thrust force F2 towards the rear is transmitted to rear base plate 18 at the level of journal axis of axle 20, and it induces, in the rear portion of base 1, a flexional moment which tends to make the heel of base 1 bend towards the slow.

Forces F1 and F2 are, in fact, generated by action and reaction. The respective intensity is not necessarily equal. It depends on the position of the axes of axles 40 and 25 with respect to the support of arm **35*b* on wedge 38**.

The moments induced in the front and rear portions of the base depend on the intensity of forces F1 and F2 as well as the height of the axes of axles 42 and 20 with respect to the upper surface of the base.

Figure 6:
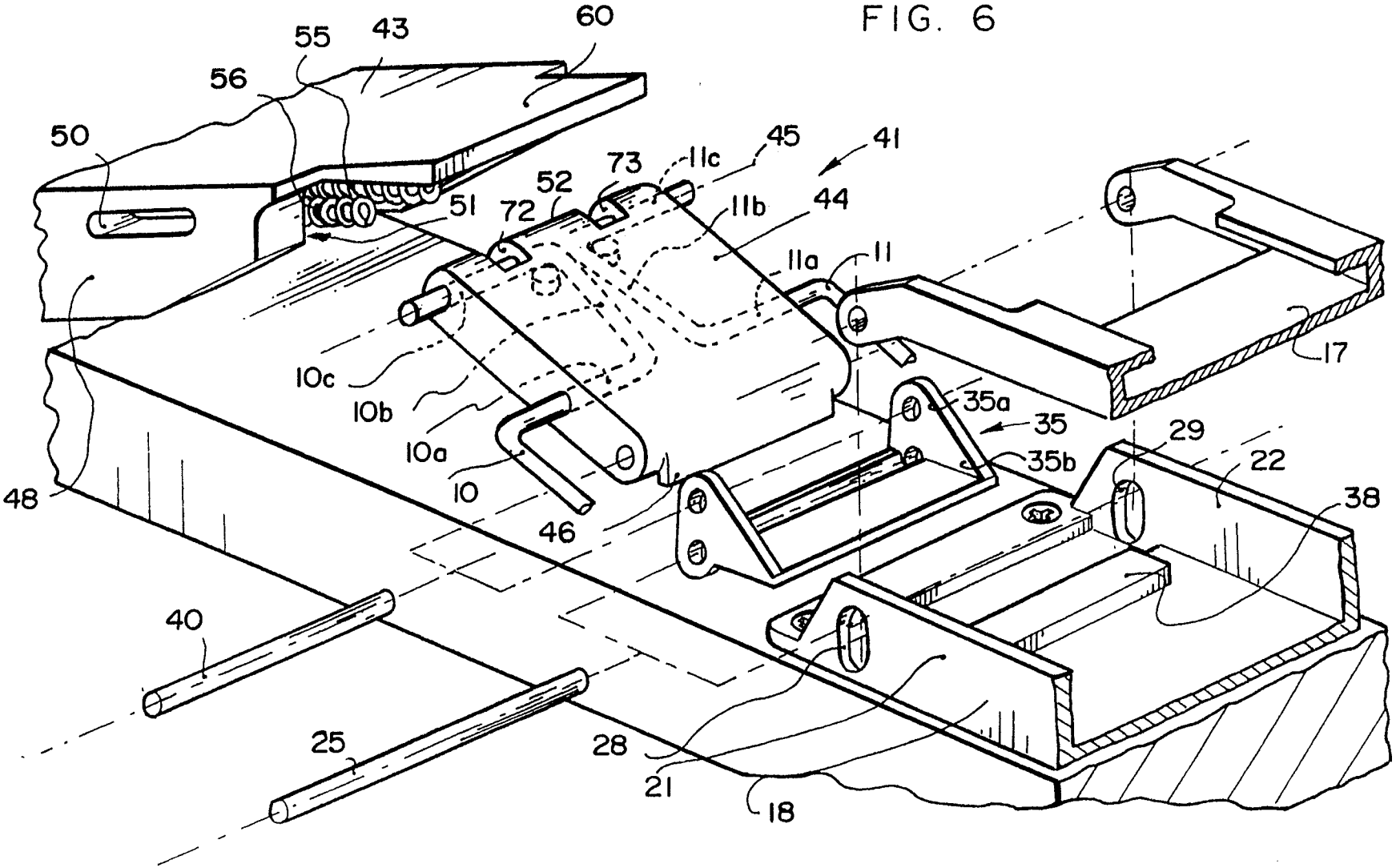
FIG. 6 is a partial exploded perspective view of the linking means which equip the device.

When the additional thrust P stops, the flexional moments induced on the front and rear ends of the ski diminish, the tipping element is returned to its normal resting position, i.e., the position illustrated in FIG. 6, which brings back pallet 60 into its upper position, until the ends of axle 25 come into abutment in slots 28 and 29.

The additional thrust P thus engenders flexional moments on the front and rear of the ski. In addition, it brings about a vertical downward movement of pallet 60 on which the rear end of the boot rests. This movement is opposed by an elastic energy. There is thus a vertical shock absorption or suspension effect of the rear end of the sole of the boot.

If the boot leaves the binding elements which retain it onto the ski, or if one or the other of the binding elements is released accidentally or voluntarily, springs 55 and 56 elastically bring back the knuckle joint that constitutes the front linking element 41 into its open position. The pre-stress that the device induces on ski 1 disappears.

Thus, this pre-stress that the linking means induce in the base is only present when the boot itself is present in the bindings, and it disappears automatically as soon as the boot leaves the binding elements. The ski is therefore subject to pre-stress only during skiing, and there is no risk of it being irreversibly deformed by a pre-stress that is exerted permanently.

According to another characteristic of the invention, a braking device of the ski is linked to the front linking element 41 described hereinabove. In a known manner, such a braking device comprises at least one braking arm, and preferably two arms 10 and 11 that are movable between a resting position and an active working position. In the resting position, the braking arms 10 and 11 are raised above the upper surface of base 1, and in the working position, they project beneath the upper surface of base 1, so as to get implanted in the snow.

Passage from one position to the other is obtained by activation means that act in accordance with the presence or absence of the boot in the binding elements. According to the invention, the activation means are constituted by one of levers 43 and 44, or by the combined action of these two levers. On the other hand, advantageously, the braking arms 10 and 11 are carried in an affixed manner by one of the levers, and therefore, they are movable with the movement of such lever from the flattened position to the open position of knuckle joint 41. Springs 55 and 56, that elastically return the knuckle joint constituting the front linking element 41 towards its open position, also constitute the return springs of the braking device towards its working position.

In the embodiment illustrated in the drawings, braking arms 10 and 11 are connected in an affixed manner to lever 44 for its rotational movement about axis 40. Lever 44 constitutes a housing for the brake, the upper portion of braking arms 10 and 11 being maintained therein. FIG. 6 represents braking arms 10 and 11 which penetrate inside the housing by a horizontal and transverse segment 10*a*, 11*a*. The two segments are approximately in alignment with one another, and are located between the axes of axles 40 and 45. The braking arms extend thereafter by two segments 10*b*, 11*b*, that are substantially adjacent, and then by two terminal segments 10*c*, 11*c* oriented towards the outside along a horizontal and transverse direction, approximately in alignment with one another. The terminal segments 10*c* and 11*c* are located in the front portion of housing 44, and their ends project outwardly from the housing. Segments 10*c* and 11*c*, in the embodiment illustrated, constitute the journal axis of axle 45 which connects both levers 43 and 44.

The braking arms 10 and 11 thus pivot with lever 44 between the flattened position of the knuckle joint which corresponds to the resting position of the braking device, and the open position of the knuckle joint which corresponds to the working position of braking arms 10 and 11. Springs 55 and 56 which elastically return the knuckle joint into its open position also constitute the return energy of the braking arms in their working position. It must, however, be noted that springs 55 and 56 are not limiting and that any other elastic return means of lever 44 in the open position of the knuckle joint, that is the position of FIG. 3, could also be used to ensure both the return of the knuckle joint into its open position and of the brake into its working position.

Preferably, an abutment limits the movement of the brake towards its working position, so as to mainly protect the device from shocks that could occur on the rear of the brake spades. Such an abutment is visible in FIGS. 5 and 6, where it is a finger 46 affixed to lever 44 and located in the vicinity of axle 40 at the rear of such axle. This finger takes support from the top on arm 35*b* of tipping element 35 when knuckle joint 41 reaches the extreme open position.

Figure 13:
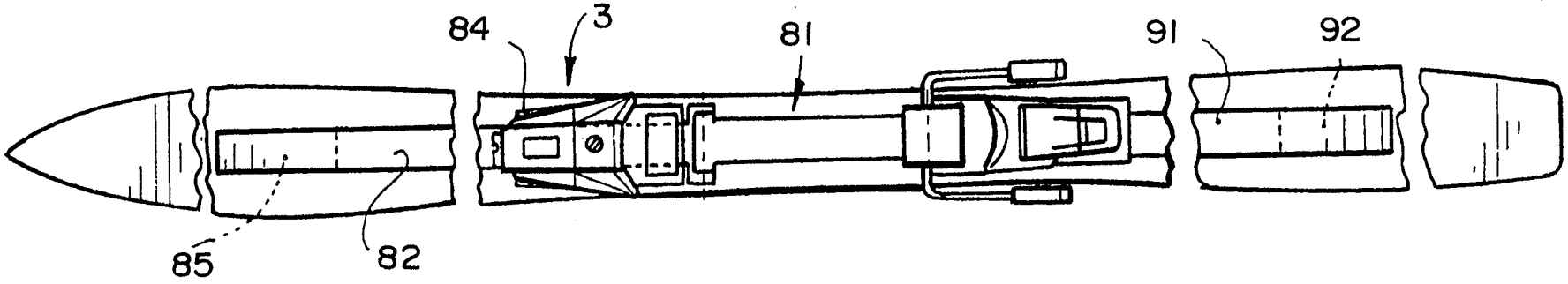
FIG. 13 is a top view of the device represented in FIG. 9.
Figure 14:
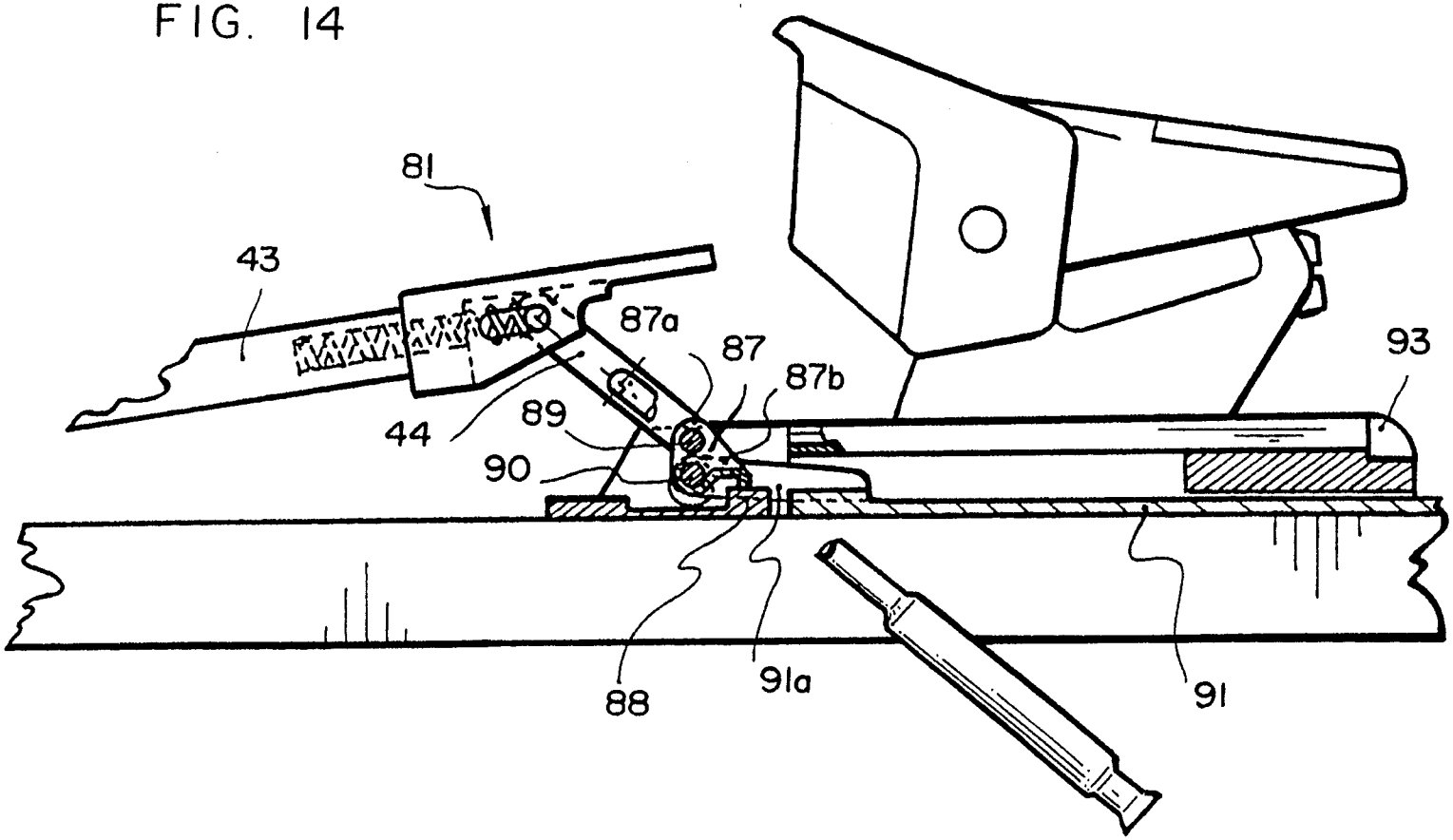
FIG. 14 is a side view, in a partial section, of the device of FIG. 1 at the level of the rear binding element.

According to a preferred embodiment, the braking device also has means to cause the retraction of the braking arms in the resting position, i.e., to bring back the braking arms in this resting position towards the longitudinal axis of the ski. With reference to FIGS. 13 and 14, the braking arms 10 and 11 can oscillate in the plane defined by housing 44 around openings 70 (see FIG. 3) crossed by segments 10*c* and 11*c*. In addition, the front portion of housing 44 has two openings 72 and 73 that springs 55 and 56 cross so as to take support against segments 10*c* and 11*c* inwardly with respect to openings 70. Springs 55 and 56 thus simultaneously have an action on lever 44 and an action on the braking arms that tends to separate braking arms 10 and 11 with respect to the longitudinal axis of the ski, as is diagrammatically represented in FIG. 13. This separated position particularly corresponds to the open position of the knuckle joint. In this position, the ends of segments 10*c* and 11*c* take support against the rear end of slot 50, which also promotes separation of braking arms 10 and 11. The separation is preferably limited by plugs 75 and 76 that are located inside the housing.

In the flattened position of the knuckle joint, the ends of segments 10*c* and 11*c* of the braking arm take support against the front end of slot 50, and this causes pivoting of the braking arms in the plane defined by lever 44 around openings 70. In this position, the braking arms come closer to the longitudinal axis of the ski.

The support of segments 10*c* and 11*c* against the front end of slot 50 only occurs at the end of the flattening movement of the knuckle joint, i.e., the retraction of the brake takes place after the braking arms have accomplished their rotational movement which brings them above the upper surface of the ski. When knuckle joint 41 is located in an intermediate position between the flattened and the open positions, it is springs 55 and 56 that exert an elastic action on segments 10*c* and 11*c*. This action tends to separate braking arms 10 and 11 from the longitudinal axis of the ski.

Naturally, the retraction means that have been described are not limiting in nature, and other means can be implemented, especially means that would act at the level of segments 10*a* and 11*a* of the brake.

Figures 5, 10:
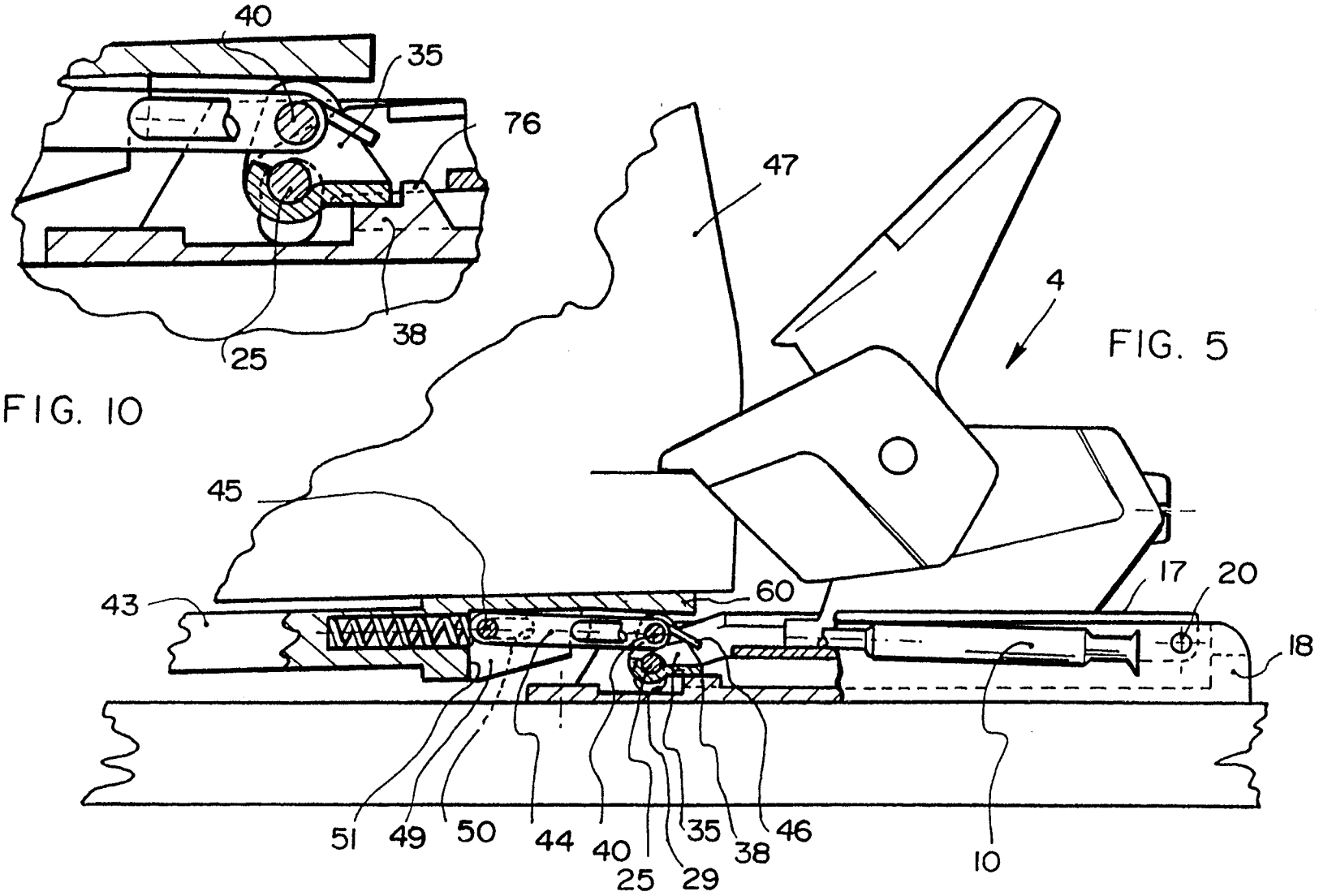
FIG. 5 is a side view, in a partial section, of the device of FIG. 1 in the rear binding element zone.
FIGS. 10 and 11 illustrate variations of the embodiment.

FIG. 10 illustrates a constructional variation of the device at the level of the linking means. According to this variation, wedge 38 on which tipping element 35 takes support has, towards the rear, a longitudinal abutment 76. When the tipping element 35 is biased rotationally by thrust P exerted by the boot, longitudinal abutment 76 absorbs the rearward longitudinal thrust force which is induced by the rotation of tipping element 35. Contrary to the above-mentioned case, this thrust is transmitted to the ski at the level of wedge 38, instead of rear journal axle 20. The flexional moment at the rear of the ski which is induced by tipping element 35 is therefore transferred to the benefit of an increased flexional moment which the front linking element 41 induces on the front end of the ski.

It is also possible for the longitudinal wedge 76 to occupy a variable longitudinal position with respect to the rear end of tipping element 35, in such a way that the tipping element takes support against wedge 76 only after a predetermined rotation.

FIG. 11 represents another variation of the embodiment according to which the support of tipping element 35 on wedge 38 is longitudinally movable.

This enables the lever arm to be varied, the tipping element taking support therewith to cause the movement of axles 25 and 40.

A rearward displacement of the support increases the thrust action exerted by tipping element 35 on the front and rear linking elements.

On the other hand, if the support of the tipping element on wedge 38 were to be displaced towards the front, the action of the tipping element would decrease.

The adjustment means represented in FIG. 11 comprise a longitudinal groove 77, represented by base plate 18 of the rear binding element. Wedge 38 can be displaced along this groove and immobilized by a screw 78. Naturally, any other means can also be used.

Figure 12:
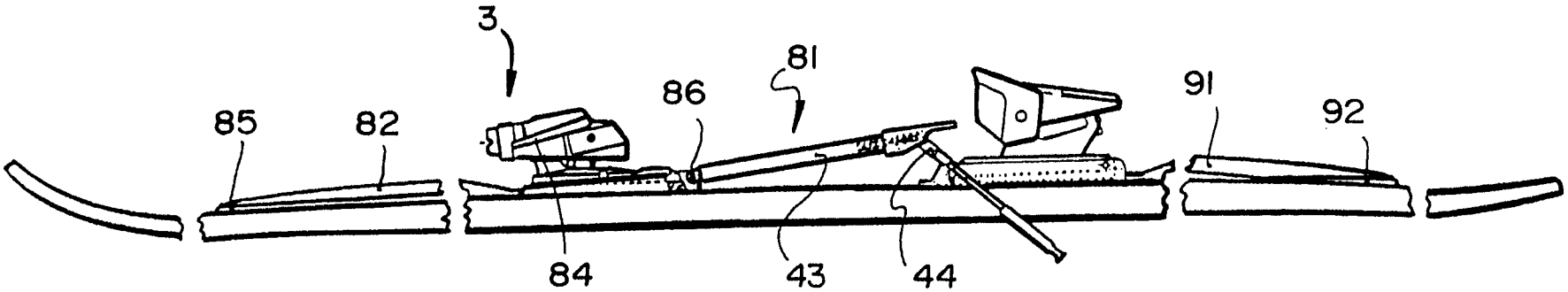
FIG. 12 is a side view of a ski equipped with a device according to another embodiment of the invention.

FIG. 12 illustrates another variation according to which the linking means are directly connected on the base of the ski, without having any effect on the binding elements or their base. This figure represents a linking element 81 similar to the front linking element 41 described hereinabove. Linking element 81 is journalled in its front portion to a stiffening member or stiffener 82 which passes freely beneath base plate 84 of the front binding element 3, and which extends towards the front where its end 85 is affixed to the upper surface of base 1. The journal between linking element 81 and front stiffener 82 is obtained by any appropriate means, for example, by a horizontal and transverse journal axis diagrammatically represented by reference numeral 86.

With reference to FIG. 14, the rear portion of linking element 81 is connected to a tipping element 87 of the same type as tipping element 35 described hereinabove. The horizontal arm 87*b* of the tipping element is in support on a wedge 88 affixed to base 1 of the ski. The linking element 81 is connected to tipping element 87 by a horizontal and transverse axle 89 which is located in the upper portion of the vertical arm 87*a* of the tipping element. Axle 90 which is located substantially beneath axle 89, also connects tipping element 87, not to slide 17, but to a stiffening member 91 that extends towards the rear of the ski, where its end 92 is affixed to base 1. In the example illustrated, the link between the tipping element 87 and rear stiffener 91 is ensured by means of a cap element 91*a* affixed to the front end of stiffener 91. The rear stiffening member 91 freely crosses base plate 93 along a longitudinal direction, the plate bearing rear binding element 4. In the present case, the base plate and the slide of the binding are affixed, i.e., the body of the binding no longer has any oscillational movement in the median vertical and longitudinal plane of the ski.

The front and rear stiffening members 82 and 91 are obtained from any appropriate material which can resist a compression bias along the longitudinal direction that they define. The front and rear ends 85 and 92 are affixed to the upper surface of base 1 by any appropriate means, and for example, by adhesion, welding or screwing or by an attached cap affixed to the base. A layer of shock absorbing material may be positioned between the ends of the stiffeners and the upper surface of the base. Ends 85 and 92 of the front and rear stiffeners are respectively located between the front binding element and the spatula, the rear binding element and the heel. For example, these ends are located in the front quarter and the rear quarter of base 1.

This constructional variation functions in a similar manner to the one described previously, except for the fact that the frontward and rearward longitudinal thrust forces are transmitted to the base, not at the base plates of the binding elements, but to base 1 itself at the level of the front and rear ends 85 and 92. They generate a flexional moment at this level which tends to make the spatula or the heel of the base of the ski bend towards the snow.

The front and rear laths 82 and 91 also play a role in transmitting, from the front to the rear of the ski, or vice versa, the biases to which one end of base 1 is subject.

For example, an upward flexional bias to which the front end of the base is subject generates, in front stiffener 82, a longitudinal thrust force oriented towards the rear, which is transmitted to linking element 81 and to tipping element 87, which, if it does not pivot, transmits the entire bias to rear stiffener 91. At this level, the thrust force generates a flexional moment which bends the rear end of the base towards the snow. Conversely, a flexional bias of the rear end of the base is transmitted towards the front. This construction enables the localized pressure increases of the base on the snow to be balanced.

The front and rear stiffeners 82 and 91 also play a role in the shock absorption of the vertical vibrations to which the front and rear ends of the base are subject. Indeed, these stiffeners preferably have elastic flexional qualities along a vertical direction.

Also, it can be added that base plates 84 and 93 of the front and rear binding elements straddle stiffening stiffeners 82 and 91, they have a guide function for such stiffeners, and they especially stop them from buckling under the effect of a compression bias. Base plates 84 and 93 are, however, affixed to the base, and this results in a good transmission of forces between the boot and the base.

As in the preceding case, in this variation, a longitudinal abutment can limit the rearward movement of tipping element 87 and send back the longitudinal rearward thrust forces induced by tipping element 87 to the ski at this level.

Figure 15:
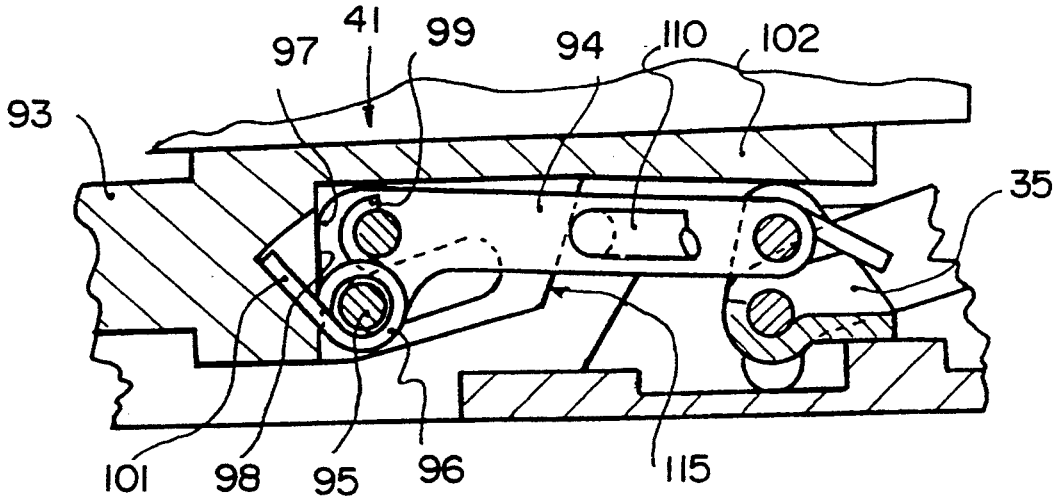
FIGS. 15–17 are related to a variation of the embodiment of the linking means.

FIG. 15 illustrates a variation of the embodiment according to which the elastic return of knuckle joint 41 into an open position is obtained by a torque spring. This spring replaces the thrust springs 55 and 56 described hereinabove.

This figure represents two levers 93 and 94 which constitute knuckle joint 41.

The levers are journalled about an axle 95 which is offset towards the base with respect to the plane defined by the main portion of lever 94.

Axle 95 is borne by lever 94 and its ends rotate in lateral slots in the rear portion of lever 93.

When the knuckle joint is flattened, i.e., in the position represented in FIG. 15, front end 97 of the knuckle joint is in support against a vertical support surface 98 of lever 93 to obtain a coupling of the two levers along a longitudinal direction, i.e., to transmit the thrust forces from one lever to the other along a longitudinal direction.

Figure 16:
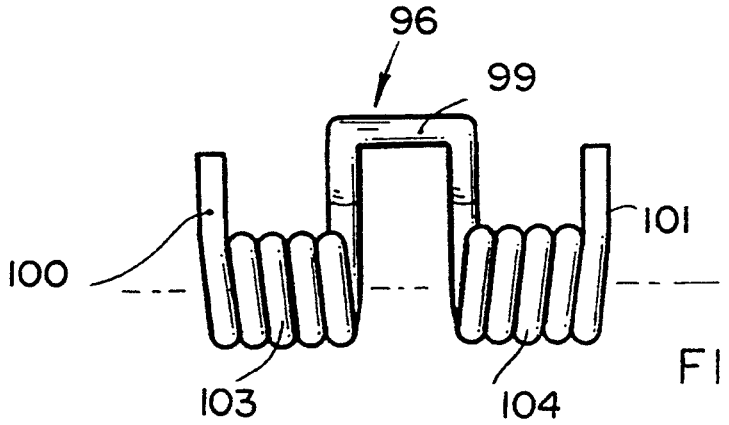

A torque spring 96 visible in FIG. 16 is wound about axle 96. The spring has two symmetrical windings 102 and 103, a central buckle 99 and two free ends 100 and 101.

The free ends 100 and 101 take support on lever 93 in the zone of the vertical support surface 98, whereas the central buckle 99 takes support on the front end 97 of lever 94.

Regardless of the position of the knuckle joint, spring 96 exerts a moment on levers 93 and 94 which elastically returns the knuckle joint towards its open position.

As in the preceding case, a plate 102 extends lever 93 towards the rear and extends above lever 94 in the flattened position of the knuckle joint.

Also, lever 94 bears braking arms 110 and 111, with their segments 110*a, b, c* and 111*a, b, c,* similar to segments 10*a, b, c,* 11*a, b, c,* described previously.

The upper segments 110*c* and 111*c* are shorter than segments 10*c* and 11*c* described previously. Indeed, they no longer have the function of a journal axis between levers 93 and 94.

Figure 17:
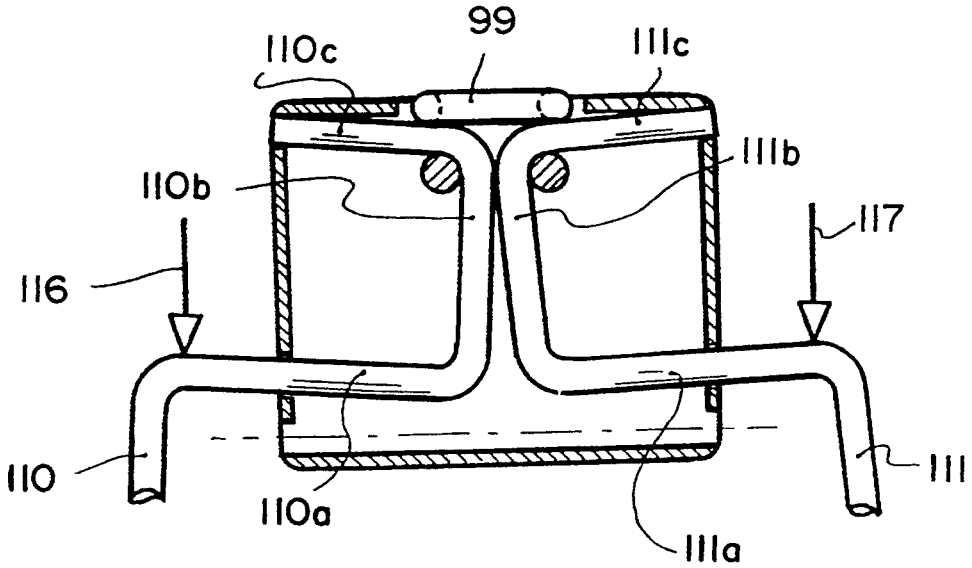

Preferably, as is visible in FIG. 17, lever 94 which constitutes the housing of the brake has, at its end 97, an opening 112 by which buckle 99 of spring 96 takes support against segments 110*c* and 111*c* in the vicinity of the median longitudinal and vertical plane defined by the ski.

The thrust force to which the braking arms are therefore subject tends to elastically keep these braking arms separate.

When the brake is brought to the retracted resting position, lateral ramps 115 borne by the lateral wings of lever 93, beneath pallet 102, take support on segments 110*a* and 110*b* of arms 110 and 111, on the outside of such segments. This action, represented diagrammatically in FIG. 17 by arrows 116 and 117, tends to bring the braking arms closer to the longitudinal axis of the ski, against the elastic return force of spring 96.

Figure 18:
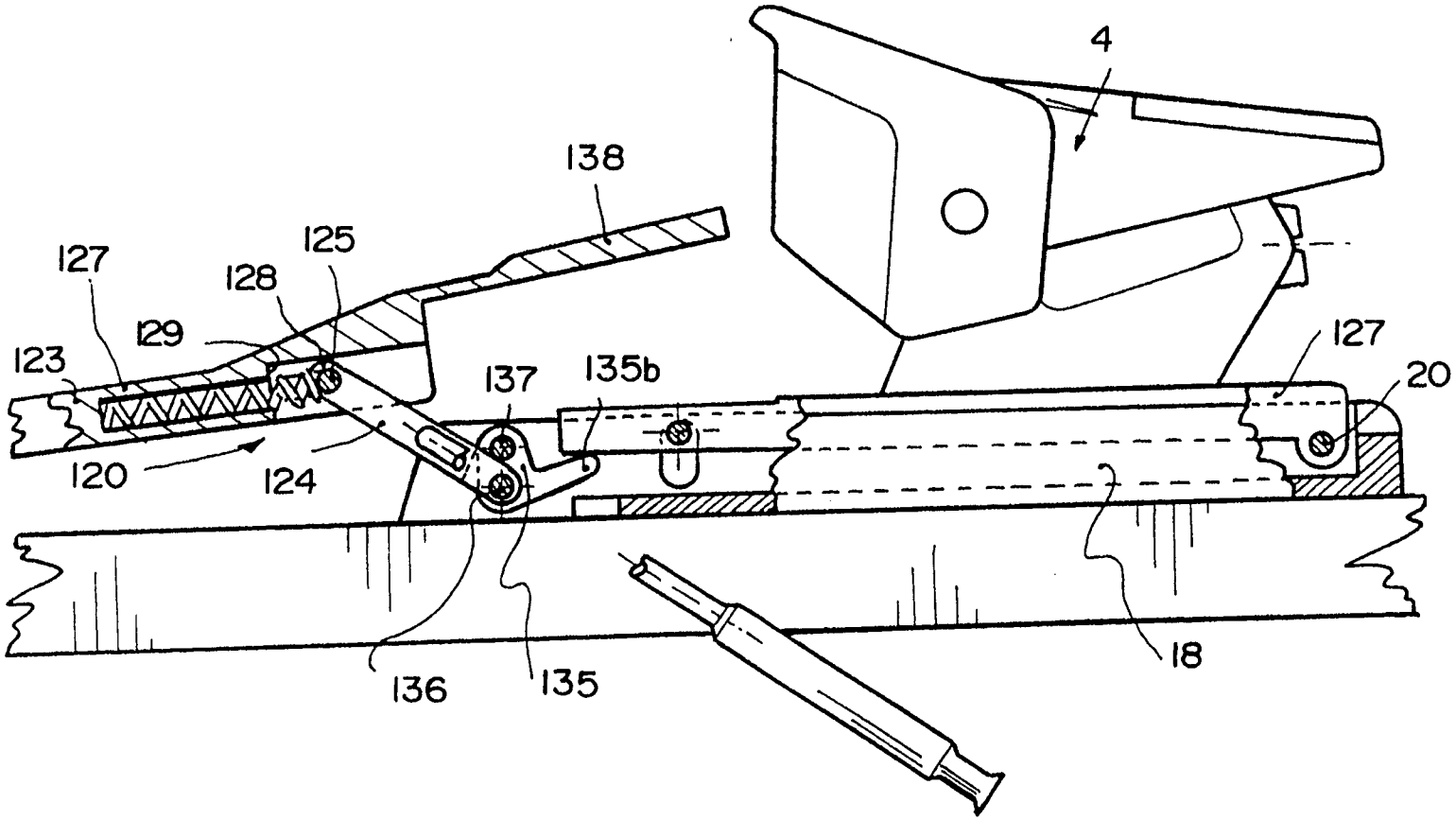
FIGS. 18 and 19 illustrate another variation of the embodiment.
Figure 19:
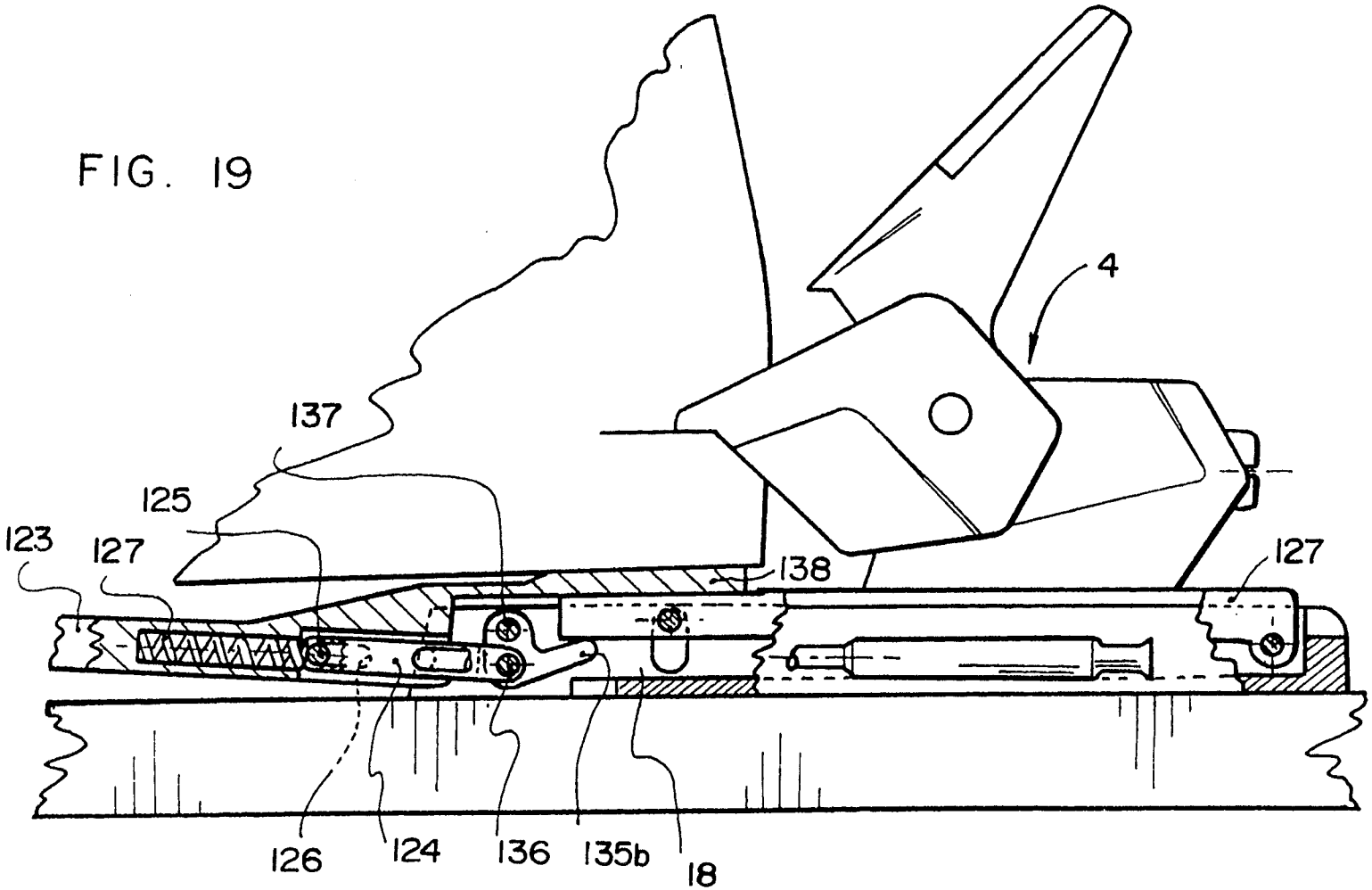

FIGS. 18 and 19 are related to another variation of the invention. According to this variation, the linking means only comprise a front linking element 120.

The linking element 120 comprises two levers 123 and 124 which are of the same type as levers 43 and 44 described previously. The two levers are journalled with respect to each other about an axis 125. The front end is connected to the front binding element in the same way as described with reference to FIGS. 3 and 4, i.e., to base plate 14 by a transverse axis 42.

As in the preceding case, axis 125 is borne by lever 124, and it rotates in a slot 126 of lever 123. Springs 127 elastically push back axle 125 towards the rear end of slot 126.

However, these springs can be replaced by a spring such as spring 96, or by any other elastic return device of the knuckle joint into an open position.

In the flattened position of the knuckle joint, front end 128 of lever 124 comes into contact against a vertical support surface 129 of lever 123.

The free rear end of lever 124 is connected to a tipping element 135 having two arms, about an axis 136 which is located in the central portion of the tipping element.

The tipping element 135 is itself journalled about an axis 137 located in its upper portion, and which is carried by the lateral wings of rear base plate 14.

The tipping element 135 has, towards the rear, an arm **135*b* on which the front portion of rear slide 127 comes to rest, along a vertical direction. This slide, along which the body of rear binding element 4 slides, is journalled with respect to base plate 18 about axis 20** located in its rear portion.

Lever 123 extends towards the rear above lever 124, by a plate 138.

In the flattened position of the knuckle joint, the boot is in support on plate 138 which is itself in support on the front portion of slide 127.

The vertical downward biases of the boot are sensed by sensor 138 and transmitted to tipping element 35 by means of slide 127.

They tend to make tipping element 135 pivot about axis 137, and this drives the journal axis 136 of front lever 123 towards the front.

The biases induce, at the level of the front base plate, a flexional moment which is transmitted to the ski. The reaction is transmitted to the ski at the level of axis 137.

The pre-stress induced in the front linking element is created by the contact of lever 124 against support surface 129, and by the return force of springs 127.

Naturally, the present description is only provided as a non-limiting example, and other variations of the invention can be adopted without leaving the scope of such invention.

In particular, the various embodiments which have been described could be equipped with a length adjustment device, so as to adapt the linking means to various boot lengths.

The instant application is based upon French patent application 92.01958 of Feb. 18, 1992, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A device for modifying the pressure distribution of a ski over a sliding surface of the ski, the ski having an elongate base which is equipped with at least one binding element adapted to retain a boot in a central zone of the ski and at least one support element on which the sole of the boot rests, wherein the device comprises:

a sensor element for sensing vertical forces exerted by the boot;

a linking device connected to the sensor element and adapted to be secured to the base of the ski, to thereby extend between and link the sensor element and the base of the ski, so as to transmit at least towards one of the ends of the base, in the form of a flexional moment directed for bending an end of the base of the ski, at least a portion of a vertical downward thrust of the boot being sensed by the sensor element, said linking device being connected at fixed longitudinally spaced points with respect to the ski;

a calibration device for inducing, in the linking device, a variable pre-stress between two values, a predetermined non-zero value for sliding with the sole of the boot in engagement with the sensor element, and a zero value with the sole of the boot disengaged from the sensor element, wherein the linking device comprises an activation mechanism responsive to the presence or absence of the boot for automatically controlling a pre-stressing of the calibration device when the boot is engaged with the at least one binding element, wherein said liking device produces opposing longitudinally directed forces to the ski at said fixed points.

2. Device as defined by claim 1, wherein:

the linking device comprises two levers journalled with respect to each other about a horizontal and transverse axis in the manner of a non-stable knuckle joint which is movable between an open position and a flattened position, wherein each lever comprises a free end journalled to the the remaining lever about a transverse and horizontal axis, wherein one of the levers carries the sensor which is sensitive to the presence of the boot; and said calibration device comprises an elastic return device for elastically returning the knuckle joint into an open position, such that in the absence of the boot, the knuckle joint opens automatically, and wherein the engagement of the boot in the binding results in the flattening of the knuckle joint.

3. Device as defined by claim 2, wherein:

the calibration device comprises at least one pre-stressing spring for exerting a variable pre-stress between a predetermined value in the presence of the boot when the knuckle joint is in the flattened position and an approximately zero value in the absence of the boot when the knuckle Joint is in the open position.

4. Device as defined by claim 3, wherein:

the journal axis of the two levers is positioned for movement along a longitudinal direction of one of the levers; and the at least one spring push back the journal axis towards an end of said one of the levers so as to elastically return the knuckle joint into the open position.

5. Device as defined by claim 4, wherein:

the at least one spring are borne by the lever along which the journal axis is movable and take support on said lever.

6. Device as defined by claim 3, further comprising:

at least one braking arm connected to one of the levers, said one of the levers being arranged for driving the braking arm upon rotation of said one of the levers about the journal axis at the pivotal element between a resting position in which the braking arms are raised, corresponding to a flattened position of the knuckle joint, and a working position in which the braking arms project beneath the lower surface of the ski, corresponding to the open position of the knuckle joint, wherein the at least one prestressing spring provide the return energy of the braking arms towards their working position.

7. A ski adapted for the practice of alpine skiing, comprising:

a base on which at least one binding element is adapted to retain a boot is assembled; and a device as defined by claim 1 for distributing pressure that the base exerts on the snow.

8. A ski brake adapted to brake the movement of a ski upon release of a boot that is held on the ski by at least one binding element, said ski brake comprising:

at least one braking arm movable between a working position in which the arm projects beneath the lower surface of the base of the ski, and a resting position in which the arm is positioned along lateral edges of the base of the ski;

activation means for returning the at least one braking arm from the working position to the resting position during engagement of the boot in the binding elements;

an energy means for elastically returning the at least one braking arm into the working position during release of the boot;

an assembly of two levers having outer portions hingedly connected with respect to the ski and being journalled at inner portions with respect to each other for movement about a longitudinal and transverse axis in the manner of a non-stable knuckle joint movable under the action of the boot between an open position and a flattened position against the upper surface of the base of the ski, wherein one of the levers bears the at least one braking arm and one of the levers extends from an area of a rear portion of a front binding element to an area proximate a rear portion of the sole of a boot when positioned upon the ski;

linking means for connecting the two levers to the base of the ski, the linking means comprising means for generating a calibration pre-stress when the boot is engaged in the at least one binding element and for activating the knuckle joint into a flattened position.

9. Ski brake as defined by claim 8, wherein:

the journal axis of the two levers is movable along the longitudinal direction of one of the levers; and at least one spring carried by such lever elastically returns the journal axis in the direction of an opening of the knuckle joint.

10. Ski brake as defined by claim 9, wherein:

in the flattened position of the knuckle joint, an end of one lever is in support against a longitudinal abutment affixed to the other lever.

11. Ski brake as defined by claim 9, wherein:

in the flattened position of the knuckle joint, both of the levers are movable along a vertical direction in response to vertical biases exerted by the boot on the base of the ski; and the linking means comprise means for transforming the vertical biases to which the two levers are subject into at least one thrust force directed towards one end of the ski.

12. Ski brake as defined by claim 9, wherein:

the linking means comprise retraction means for the braking arms for bringing the braking arms closer towards the longitudinal axis of the ski, when the brake is placed in a raised resting position.

13. Ski brake as defined by claim 8, wherein:

the journal axis of the two levers is constituted by two upper extensions of the at least one braking arm, said upper extensions being located in an upper portion of the lever bearing the at least one braking arm, said upper extensions being oriented along an approximately co-axial horizontal and transverse direction.

14. Ski brake as defined by claim 13, wherein:

the linking means comprise retraction means for the braking arms for bringing the braking arms closer towards the longitudinal axis of the ski, when the brake is placed in a raised resting position;

the journal axis of the two levers is displaced in a slot carried by one of the levers; and the retraction means are constituted by a front end of the slot against which lateral ends of the extensions of the braking arms come into abutment in a flattened position of the knuckle joint.

15. Ski brake as defined by claim 8, wherein:

the linking means are adapted to be connected, towards the front, to a front base plate adapted to be affixed to the base of the ski and, towards the rear, to a rear base plate adapted to be affixed to the base of the ski.

16. Ski brake as defined by claim 8, wherein:

the linking means are adapted to be connected to the base of the ski by a front stiffener, the front stiffener having a front end adapted to be affixed to the base of the ski.

17. Ski brake as defined by claim 16, wherein:

the linking means are adapted to be connected to the base of the ski by a rear stiffener, the rear stiffener having a rear end adapted to be affixed to the upper surface of the base of the ski.

18. A ski for alpine skiing, comprising:

a base on which at least one binding element adapted to retain a boot is assembled; and a ski brake as defined by claim 27 for braking the ski in case of release of the boot held by the at least one binding element.

19. A device for modifying the pressure distribution of a ski over a sliding surface of the ski, the ski having an elongate base which is equipped with at least one binding element adapted to retain a boot in a central zone of the ski and at least one support element on which the sole of the boot rests, wherein the device comprises:

a sensor element for sensing vertical forces exerted by the boot;

a linking device connected to the sensor element and adapted to be secured to the base of the ski, to thereby extend between and link the sensor element and the base of the ski, so as to transmit at least towards one of the ends of the base, in the form of a flexional moment directed for bending an end of the base of the ski, at least a portion of a vertical downward thrust of the boot being sensed by the sensor element, the linking device comprising two levers having outer portions hingedly connected with respect to the ski and being journalled at inner portions with respect to each other for movement about a horizontal and transverse axis in the manner of a non-stable knuckle joint which is movable between an open position and a flattened position, wherein each lever comprises a free end Journalled to the remaining lever about a transverse and horizontal axis, wherein one of the levers carries the sensor which is sensitive to the presence of the boot.

20. A device according to claim 19, further comprising:

a front base plate for supporting a front binding and a rear base plate for supporting a rear binding, wherein said two levers extend between said front base plate and said rear base plate.

21. A device according to claim 19, wherein:

said linking device comprises means for transmitting said flexional moment toward said front base plate and/or toward said rear base plate.

22. Device as defined by claim 19, wherein:

in the flattened position of the knuckle joint, the two levers are coupled to one another in an affixed manner along a longitudinal direction.

23. Device as defined by claim 19, wherein:

in the flattened position of the knuckle joint, an end of one lever takes support along a longitudinal direction against a support abutment of the other lever.

24. Device as defined by claim 19, wherein:

the journal axis of the two levers is borne by one of the levers along a slot oriented along the longitudinal direction of the lever; and in the flattened position of the knuckle joint, the journal axis is located in abutment at an end of the slot.

25. Device as defined by claim 19, wherein:

the linking device comprises a pivotal element with two arms, the pivotal element being journalled about a transverse axis, and wherein a free end of one of the levers is journalled to the pivotal element about a horizontal and transverse journal axis.

26. Device as defined by claim 25, wherein:

the linking device comprises, for a front binding element, a base plate affixed to the base of the ski, to which a free end of a lever of the knuckle joint is connected about a horizontal and transverse axis which is raised with respect to an upper surface of the base.

27. Device as defined by claim 26, wherein:

the linking device comprises, for a rear binding element, a base plate affixed to the base of the ski, and a slide journalled to the base plate about a horizontal and transverse axis and to the pivotal element about a horizontal and transverse axis located at the junction of the two arms of the pivotal element.

28. Device as defined by claim 27, wherein:

the pivotal element comprises a horizontal arm in support against a wedge adapted to be affixed to an upper surface of the base of the ski.

29. Device as defined by claim 28, further comprising:

an adjustment mechanism for adjustably positioning the wedge along a longitudinal direction.

30. Device as defined by claim 28, further comprising:

a longitudinal abutment for limiting longitudinal rearward displacement of a free arm of the tipping element.

31. Device as defined by claim 29, further comprising:

means for limiting upward vertical displacement of the sensor element beyond a predetermined amount.

32. Device as defined by claim 27, wherein:

the linking device comprises the ends of a pin affixed to the slide of a rear binding element, said ends of the pin being arranged to circulate in oblong holes of the base plate which bears the rear binding element.

33. Device as defined by claim 27, wherein:

the journal axis of the slide at the pivotal element has ends that circulate in oblong holes of the base plate which bears the rear binding element.

34. Device as defined by claim 19, wherein:

in the presence of the boot, the levers of the knuckle joint constitute the sensor element and are arranged for movement along a vertical direction and are arranged to be capable of sensing downward vertical biases exerted by the boot on the ski and of transmitting said biases to the linking device.

35. Device as defined by claim 19, wherein:

the linking device comprises, at the front, a stiffener, the stiffener having a rear end connected to the free end of a lever of the knuckle joint and the stiffener having a front end adapted to be affixed with respect to an upper surface of the base of the ski.

36. Device as defined by claim 19, wherein:

the linking device comprises, for a rear binding element, a linking blade having a front end connected to the pivotal element of the linking device and having a rear end affixed to an upper surface of the base of the ski.

37. Device as defined by claim 19, wherein:

one of the levers extends beyond the journal to the other lever by a plate, the plate covering the other of the levers in the flattened position of the knuckle joint so as to constitute a support element on which the rear end of the sole of the boot rests.

38. Device as defined by claim 19, further comprising:

at least one braking arm connected to one of the levers, said one of the levers being arranged for driving the braking arm upon rotation of said one of the levers about the journal axis at the pivotal element between a resting position in which the braking arms are raised, corresponding to a flattened position of the knuckle joint, and a working position in which the braking arms project beneath the lower surface of the ski, corresponding to the open position of the knuckle joint.

39. Device as defined by claim 38, wherein:

the linking device comprises retraction means for the braking arms for bringing the braking arms closer to the longitudinal axis of the ski, when the brake is placed in a raised resting position.

40. Device as defined by claim 38, wherein:

the at least one braking arm comprises two braking arms;

the journal axis of the two levers is constituted by two upper extensions of the two braking arms., said upper extensions being located in an upper portion of the lever bearing the braking arms, said upper extensions being oriented along an approximately co-axial horizontal and transverse direction.

41. Device as defined by claim 40, wherein:

the linking device comprises retraction means for the braking arms for bringing the braking arms closer to the longitudinal axis of the ski, when the brake is placed in a raised resting position;

the retraction means a front end of a slot against which lateral ends of the extensions of the braking arms come into abutment in the flattened position of the knuckle joint.

* * * * *